US005847341A

United States Patent [19]

Godesa

[11] Patent Number: 5,847,341

[45] Date of Patent: Dec. 8, 1998

[54] EVALUATION APPARATUS FOR A POWDER SWITCH MUTUALLY LOCKING SYSTEM

[75] Inventor: Ludvik Godesa, Berlin, Germany

[73] Assignee: Siemens Aktiengesellschaft, München, Germany

[21] Appl. No.: 817,985

[22] PCT Filed: Oct. 30, 1995

[86] PCT No.: PCT/DE95/01518

§ 371 Date: Apr. 25, 1997

§ 102(e) Date: Apr. 25, 1997

[87] PCT Pub. No.: WO96/13841

PCT Pub. Date: May 9, 1996

[30] Foreign Application Priority Data

Oct. 31, 1994 [DE] Germany ..... 44 39 746.1

[51] Int. Cl.[6] ..... H01H 1/20; H01H 3/20; G05G 11/00

[52] U.S. Cl. ..... 200/50.32; 200/331; 74/479.01

[58] Field of Search ..... 200/18, 50.25, 200/50.36, 331, 50.32; 74/479.01, 501.6, 502; 192/131 R

[56] References Cited

U.S. PATENT DOCUMENTS

| | | | |
|---|---|---|---|
| 4,019,166 | 4/1977 | Lawrence et al. | 200/330 |
| 4,433,591 | 2/1984 | Green | 74/479 |
| 4,626,638 | 12/1986 | Samples et al. | 200/331 |

FOREIGN PATENT DOCUMENTS

| | | |
|---|---|---|
| 36 11 020 | 10/1987 | Germany . |
| 44 09 172 | 9/1994 | Germany . |

*Primary Examiner*—Wynn Wood Coggins
*Assistant Examiner*—Michael Hayes
*Attorney, Agent, or Firm*—Kenyon & Kenyon

[57] ABSTRACT

An evaluation apparatus for the transmission of mechanical motion used in a system for mutually locking power switches. The apparatus has a first input slide with a coupling member, which can be detachably installed as a driver for an output slide. A guide is provided on a carrier for a second input slide, arranged as a mirror image to the first input slide in relation to the output slide. The evaluation apparatus operates as an AND element when the output slide is equipped with a roller, and the output slide operates optionally as an AND or an OR element when the input slide is provided with one or more additional coupling members.

5 Claims, 4 Drawing Sheets

EVALUATION APPARATUS FOR A POWDER SWITCH MUTUALLY LOCKING SYSTEM

BACKGROUND OF THE INVENTION

1. Field of the Invention

The present invention concerns an evaluation apparatus for the transmission of mechanical motion used in a system for mutually locking power switches. The power switches a carrier for a first input slide and an output slide guided approximately in parallel to the input slide, as well as a coupling element acting as a driver for positive transmission of a motion of the first input slide into a motion of the output slide.

2. Description of the Prior Art

An evaluation apparatus was disclosed by German Patent 44 09 172 A1. The coupling between two input slides and an output slide is achieved through an approximately T-shaped coupling member. A positive coupling is established so that the motion of one of the two input slides causes the output slide to move. This corresponds to an OR function. If the T-shaped coupling member is designed as a rocker with a constrained pivoting angle, the evaluation apparatus operates as an AND element.

SUMMARY OF THE INVENTION

The object of the present invention is to provide an evaluation apparatus operating as an AND or OR element whose function can be switched by the user in a simple manner.

This object is achieved according to the present invention by the fact that the coupling member in the first input slide can be detachably installed, the carrier has a guide for a second input slide assigned, if needed to the first input slide and arranged approximately as a mirror image in relation to the output slide. The output slide has symmetrically arranged extension arms serving as a stop for the coupling member of the first input slide and optionally the second input slide.

The embodiment with one input slide only and with a coupling member installed in the input slide forms the basic embodiment of the evaluation apparatus. The input slide and the output slide are coupled together so that the motion of the input slide is transmitted synchronously to the output slide. The transmission of force can be interrupted by removing the coupling member, which can be desirable when creating locking devices for test purposes.

A mechanical OR element with two inputs can be created through the extension arms being symmetrically arranged on the output slide as a stop for the coupling member, by optionally using the second input slide in connection with the coupling members installed.

It has been proven advantageous if the input slides have a female thread where the coupling member designed as a screw can be installed. Such a coupling member is easily handled by the user and allows a simple visual check of the operation of the coupling to be performed.

The evaluation apparatus can be configured so that it can be optionally used as an AND element with two inputs through a suitable design of the input slides and the output slide without modifying the arrangement of these elements. For this purpose, the output slide must carry a roller whose diameter is larger than the distance between the first and second input slides, with the distance between the first and second input slide being widened over part of their length to accommodate the roller through a recess. The depth of each recess corresponds to at least the difference between the diameter of the roller and the distance between the first and second input slides, and the roller is movable transversally in relation to the first and second input slides. If the function of such an evaluation apparatus is considered in an embodiment without coupling members, the output slide will only move when the input slides move at the same time or consecutively. If only one of the input slides is moved, the roller is displaced outward laterally and the output slide remains at rest. The AND function and the OR function can also be combined in the same evaluation apparatus by providing only one of the input slides with a coupling member.

The transverse mobility of the above-mentioned roller with regard to the input slides can be achieved by providing the roller with a pivot bearing rigidly connected to the output slide and supporting the output slide at its end opposite the roller in a slideway. The the output slide performs a pivoting motion around this slideway.

The present invention can be advantageously used with a switch-on locking mechanism for power switches as shown in German Patent 43 33 828 C1. This device reacts to all parameters that are relevant to its readiness to switch on and releases switching-on only when the required conditions are present. In such a system, the motion of an output glide provided by an evaluation apparatus of the type explained above can be introduced as an additional parameter.

BRIEF DESCRIPTION OF THE DRAWINGS

The invention is now explained in detail using the embodiments illustrated in the drawings.

DETAILED DESCRIPTION OF THE INVENTION

Figure 1:
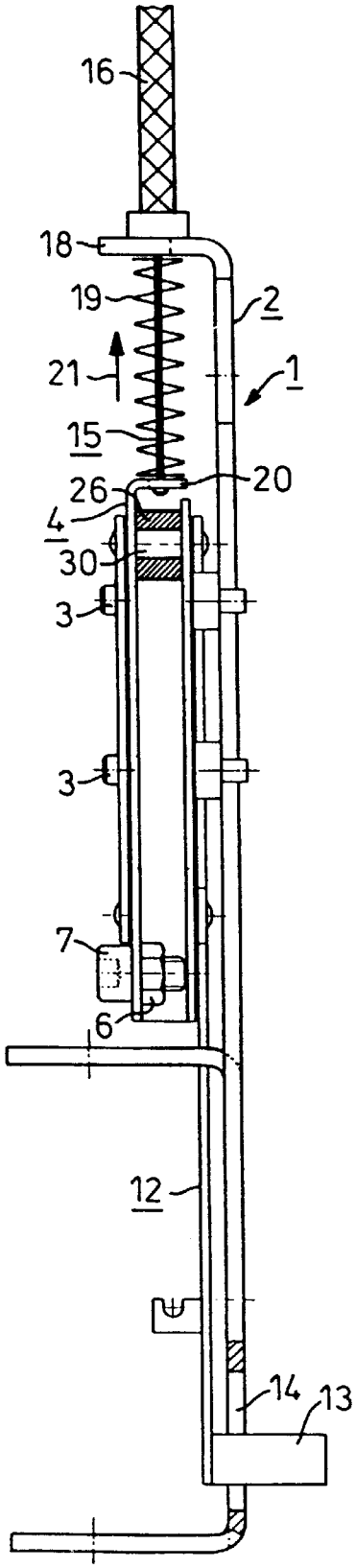
FIGS. 1 and 2 show two views of the basic form of an evaluation apparatus with a first input slide and an output slide.
Figure 2:
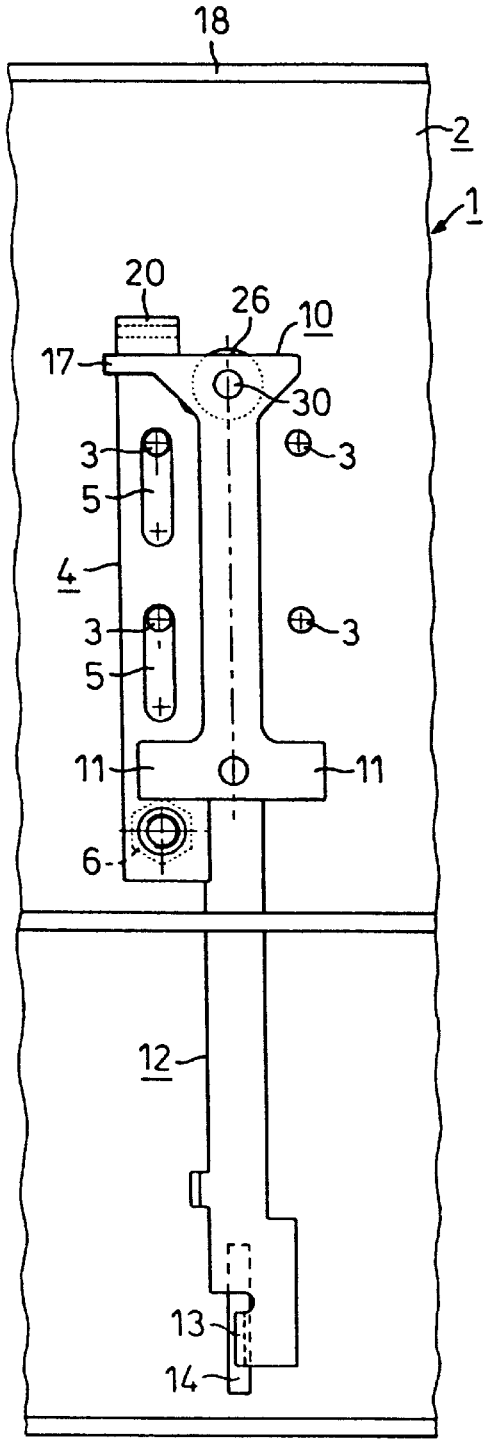
Figure 3:
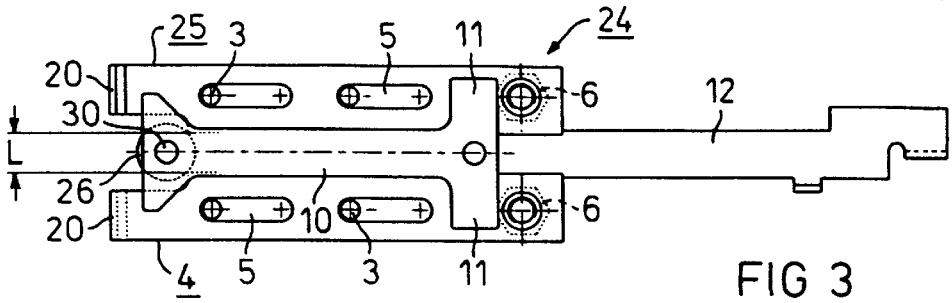
FIGS. 3, 4, 5 and 6 show the top view of an evaluation apparatus with two input slides in different positions.

The evaluation apparatus 1 according to FIGS. 1 and 2 has a carrier 2 with a total of four guide pins 3, two of which are assigned to each of the two input slides. Evaluation apparatus 1 has a first input slide 4 guided through two longitudinal holes 5 on guide pins 3. At one end, input slide 4 is provided with a female thread 6 in the form of a nut. A coupling member 7 in the form of a Philips screw is shown in FIG. 1 installed in female thread 6; it is not shown in FIG. 2.

An output slide 10 with extension arms 11 symmetrically arranged as stops for coupling members 7 is arranged approximately parallel to input slide 4. A guide rod 12, forming a single piece with output slide 10 or connected to it, overlaps, with its bent portion, 13, a guide slot 14 of carrier 2. At the opposite end, a guide arm 17 of output slide 10 overlaps input slide 4.

A Bowden control 15, whose sheathing 16 is supported by a bent portion 18 of carrier 2, engages a projection 20 of the first input slide 4. If Bowden control 15 is actuated in the direction of arrow 21, this motion is transmitted by input slide 4 to output slide 10 thanks to coupling member 7. At an appropriate point, e.g., on guide projection 13, the motion of output slide 10 can be supplied to a power switch. If the motion transmission is to be prevented, it is sufficient to remove coupling member 7.

A restoring spring 19 that returns input slide 4 into the rest position shown, when Bowden control 15 is released again after having been actuated, is also supported by bent portion 18. Restoring spring 19 is weaker than an energy accumulator 40 assigned to a position indicator 36 shown in FIGS. 8 and 9.

In the second embodiment of an evaluation apparatus 24 according to FIGS. 3 through 7, a second input slide 25, arranged as a mirror image of input slide 4 in relation to the longitudinal axis of output slide 10, is provided in addition to the above-described first input slide 4 and output slide 10. It should be noted that carrier 2, the Bowden controls and restoring springs for the two input slides 4 and 25 have been omitted in FIGS. 3–7 to simplify the illustration. Guide pins 3, allowing the two input slides 4 and 25 to be moved parallel to one another are, however, shown. Furthermore, it can be seen that output slide 10 is configured without guide arm 17, since it is between the input slides and needs no further guiding at this point.

Figure 4:
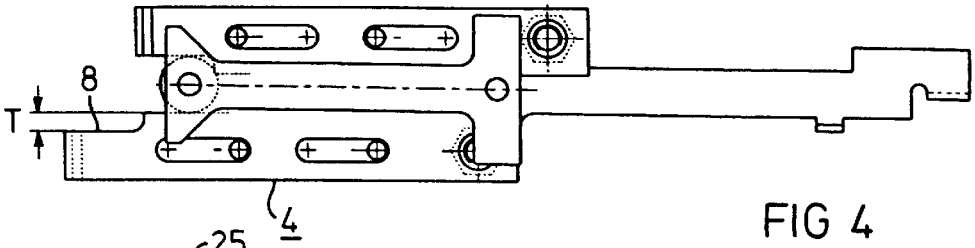
Figure 5:
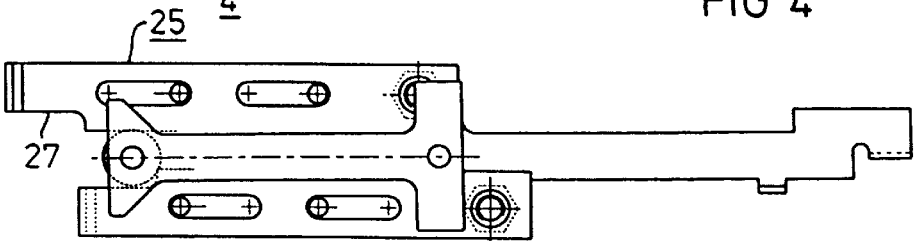

Due to the specific features of input slides 4 and 25 and output slide 10, evaluation apparatus 24 has the characteristics of an AND element in that actuating only input slide 4 or input slide 25 according to FIGS. 4 and 5 has no effect on the position of output slide 10.

Figure 6:
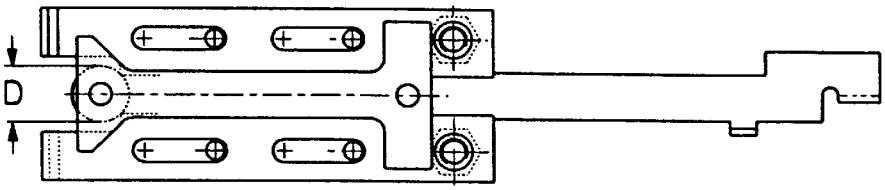
Figure 7:
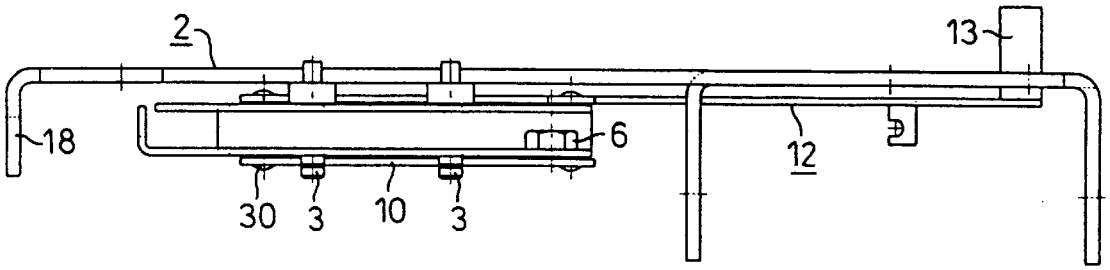
FIG. 7 shows the side view of the evaluation apparatus according to FIGS. 4 through 6.

Only when both input slides 4 and 25 are actuated (simultaneously or consecutively), is output slide 10 also moved, according to FIG. 6. This operation is based on the arrangement of a roller 26 on the front end of output slide 10. This roller is also shown in FIGS. 1 and 2, but has no effect there. A recess 8 of input slide 4 and a recess 27 of input slide 25 work together with roller 26.

As shown in FIGS. 3 through 6, diameter D of roller 26 is larger than distance L between the first input slide 4 and the second input slide 25. The above-mentioned recesses 8 and 27 have a depth T, which corresponds to at least the difference between diameter D and distance L. Roller 26, connected to output slide 10 via pivot bearing 30 can thus pivot in the direction of input slide 25 if only input slide 4 is actuated according to FIG. 4. If only input slide 25 is actuated according to FIG. 5, roller 26 is accommodated in recess 8 of input slide 4. Only if the first input slide 4 and the second input slide 25 are actuated simultaneously according to FIG. 6 is roller 26 engaged by the shoulders formed by recesses 8 and 27 and output slide 10 is therefore moved synchronously as shown in FIG. 6.

As explained earlier, the first input slide 4, the second input slide 25, or both input slides can optionally be provided with a coupling member 7 according to FIG. 1. If only one input slide is provided with a coupling member, the motion of the respective input slide 4 or 25 results in the forced motion of output slide 10. Actuating only the other input slide, however, has no effect on output slide 10. If both input slides 4 and 25 are equipped with coupling members, then evaluation apparatus 24 has the function of an OR element with two inputs.

Figure 8:
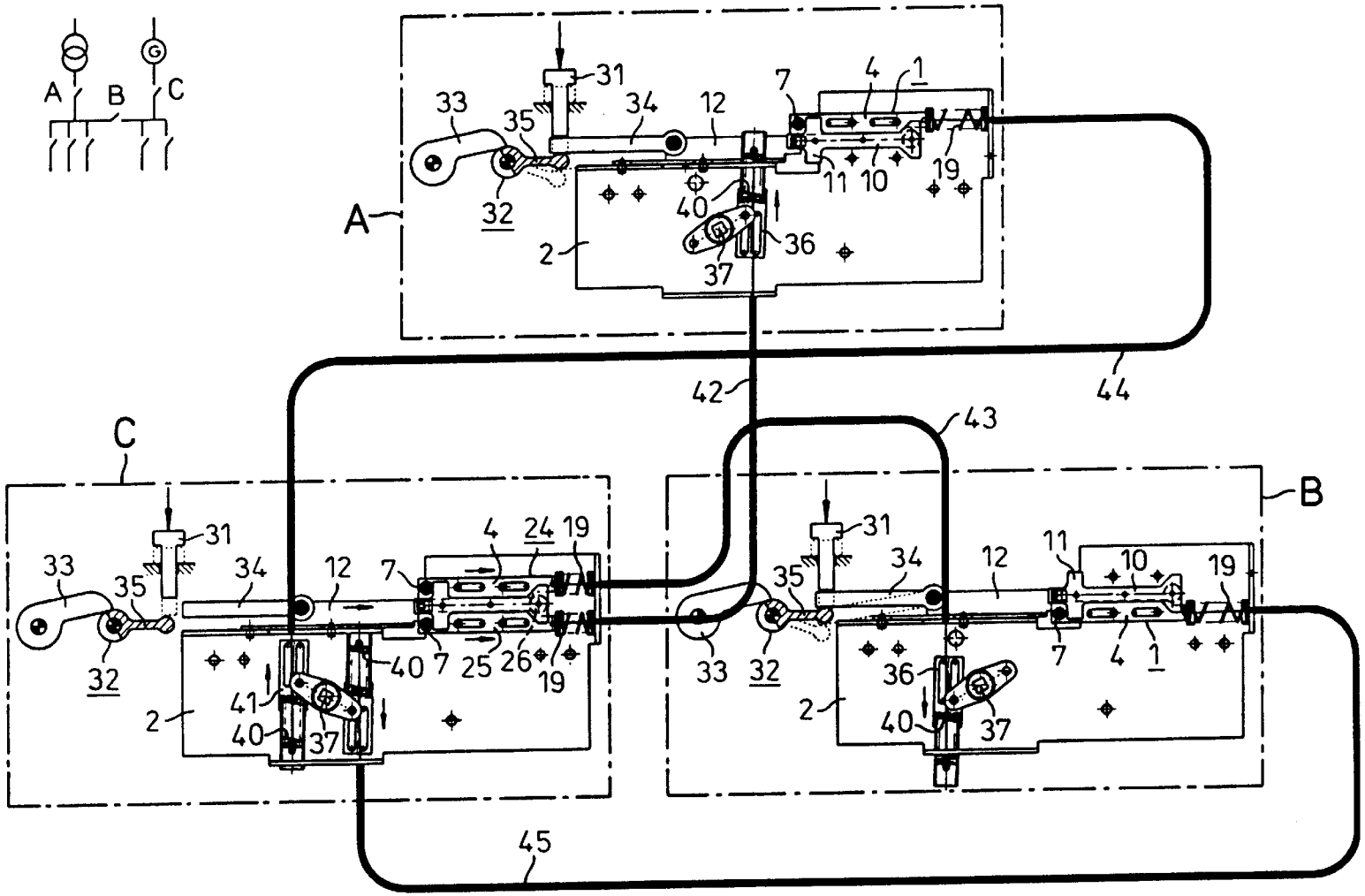
FIG. 8A schematically shows a first embodiment of a mutual locking mechanism for three power switches using evaluation apparatuses according to FIGS. 1 through 7.
FIG. 8B–C is an electrical schematic of the switches of FIG. 8.

The interaction of evaluation apparatuses 1 and 24 with the power switches is now explained using a first embodiment illustrated in FIG. 8. Operation of a configuration of the type shown in FIG. 8A is described in the application entitled ARRANGEMENT FOR MUTUALLY LOCKING POWER SWITCHES, based upon PCT/DE95/01520 and filed on even date herewith. In FIG. 8A the arrangement of three power switches A, B, C is shown initially using a schematic wiring diagram. Power switch A is a supply switch for a transformer and power switch C is a supply switch for a generator. Power switch B is arranged within a bus, to whose sections power switches A and C are connected. In of FIG. 8, power switches A, B, and C are enclosed within a dot-and-dash line. Each of power switches A, B, and C has an ON pushbutton 31 and a switching-on semishaft 32 actuated by ON pushbutton 31, supporting switching-on latch 33. The release of switching-on latch 33 causes the switching contacts (not shown) to close in a known manner. As can be seen in particular by comparison of power switch A with power switch C in FIG. 8, actuating ON pushbutton 31 only causes switching-on semishaft 32 to rotate if a locking slide 34 connected to output slide 10 is between ON pushbutton 31 and an extension 35 mounted on switching-on semishaft 32. This arrangement forms a switch-on locking mechanism as described in detail in German Patent 43 33 828 C1.

Each of power switches A, B, and C also has a position indicator 36 or 41, which has an actuating shaft 37 coupled with a switching shaft of the respective power switch in an appropriate manner. A Bowden control is actuated via these position indicators 36 and 41 via a spring accumulator 40. Position indicators 36 and 41 are provided to provide a position signal, while position indicator 41 has a dual action and is thus capable of performing two motions signaling the switching position.

Spring accumulator 40 has the functions of protecting the Bowden control, which connects position indicator 36 or 41 with an evaluation apparatus 1 or 24, against the jerky rotation of actuating shaft 37 when the respective power switches A, B, and C are switched on. Spring accumulator 40 is dimensioned so as to overcome all the friction, actuating the respective input slide and loading restoring spring 19. Thus energy is available for returning the entire system consisting of the evaluation apparatus, Bowden control, and position indicator, to its initial position when the respective power switch A, B, and C is switched off. A dead travel coupling can ensure that the Bowden control (or the rod assembly provided for the same purpose) is not subjected to jerky motion.

Each of power switches A and B configured with coupling member 7 installed is equipped with an evaluation apparatus 1 according to FIGS. 1 and 2. Power switch C has an evaluation apparatus 24, also configured with coupling members 7 installed in both input slides. A total of four Bowden controls 42, 43, 44, and 45 establish the connection between position indicators 36 and evaluation apparatuses 1 and 24. Bowden control 42 connects position indicator 36 of power switch A to evaluation apparatus 24 of power switch C. Furthermore, position indicator 36 of power switch B is connected to evaluation apparatus 24 of power switch C. Position indicator 41 of power switch C is connected to evaluation apparatuses 1 of power switches A and B via Bowden controls 44 and 45. This results in the following operation of the arrangement shown:

If power switch C is on, which corresponds to current flowing to the generator shown in FIG. 8*a*, power switches A and B are locked, since the respective locking slides 34 are drawn away from ON pushbutton 31 by output slide 10 and therefore actuating the ON pushbutton 31 remains ineffective. If, however, either power switch A or power switch B or both of these power switches are switched on, this causes power switch C to be locked. This is the status shown in FIG. 8.

Figure 9:
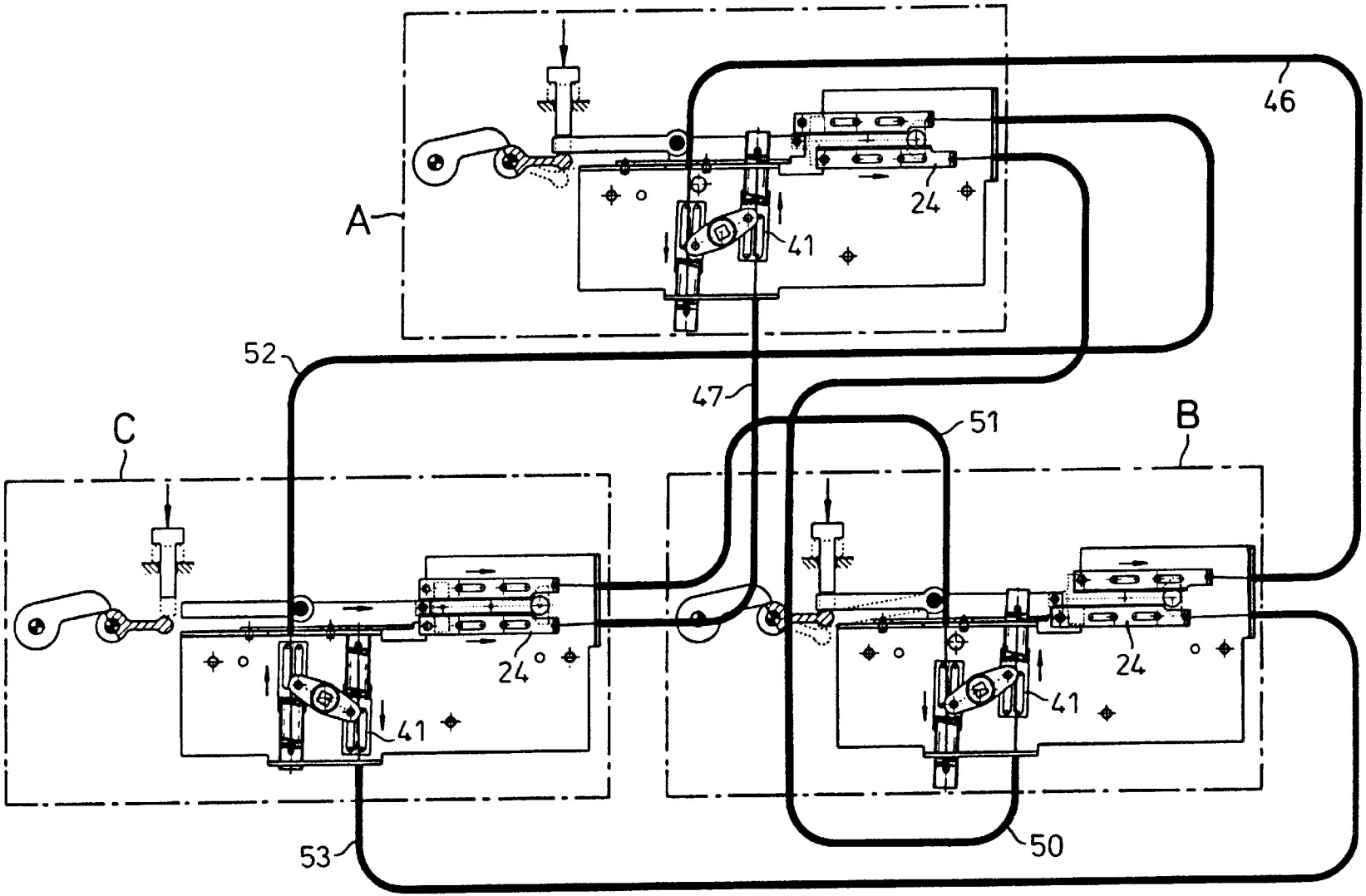
FIG. 9 shows a second embodiment of a mutual locking device for three power switches, two of which can be switched while the remaining third power switch is locked.

In another embodiment according to FIG. 9, three power switches A, B, and C are also provided, which are interlocked using position indicators 41 with two outputs each and evaluation apparatuses 24 with two input slides so that only one power switch can be switched on at a time. For this purpose, position indicator 41 of power switch A is connected to evaluation apparatus 24 of power switches B and C via Bowden controls 46 and 47. Bowden controls 50 and 51 logically connect power switch B to the evaluation apparatuses of power switches A and C. The remaining power switch C is connected to power switches A and B via Bowden controls 52 and 53. Thus a total of six Bowden controls are used. Evaluation apparatuses 24 have no coupling members 7 in this embodiment and therefore operate as AND elements. FIG. 9 shows the status where power switches A and B are switched on and thus power switch C is locked against switching on. Power switches A or B are logically locked if the remaining power switches B and C or A and C are switched on.

What is claimed is:

1. An evaluation apparatus for transmitting a mechanical motion, comprising:

at least two power switches, the power switches each comprising a carrier, a first input slide and an output slide, the output slide being guided approximately parallel to the first input slide, the power switches each comprising a coupling member providing positive transmission of motion of at least the first input slide into a motion of the output slide, the carrier comprising a guide for the first input slide; and a second input slide, wherein the coupling member comprises a roller mounted on the output slide, the roller having a diameter larger than a distance between the first and second input slides, wherein the first and second input slides comprise recesses, and wherein the distance between the first and second input slides adjacent the roller is increased as a result of the recesses, to thereby accommodate the roller within one of the recesses the depth of each recess corresponding to at least a difference between the diameter of the roller and the distance between the first and second input slides, and wherein the roller is movable transverse to the first and second input slides.

2. The evaluation apparatus according to claim 1, wherein:

the coupling member comprises a screw detachably mounted on the first input slide, and wherein the input slide has a female thread into which the coupling member can be installed.

3. The evaluation apparatus according to claim 1, wherein:

the roller comprises a pivot bearing rigidly connected to the output slide, and wherein the output slide is supported at an end opposite the roller by a slideway.

4. The evaluation apparatus according to claim 1, further comprising:

a restoring spring supported on the carrier, and wherein the restoring spring returns the first input slide to a rest position.

5. The evaluation apparatus according to claim 1, wherein:

the second input slide is approximately a mirror image, relative to the output slide, of the first input slide, and wherein the output slide comprises symmetrically arranged extension arms serving as stops for additional coupling members detachably mounted to the first input slide and the second input slide.

* * * * *